United States Patent [19]

Lieser

[11] 4,404,874

[45] Sep. 20, 1983

[54] SCREWDRIVER WITH REPLACEABLE BLADE

[75] Inventor: Karl Lieser, Wuppertal, Fed. Rep. of Germany

[73] Assignee: Firma Hermann Werner GmbH & Co., Wuppertal, Fed. Rep. of Germany

[21] Appl. No.: 232,781

[22] Filed: Feb. 9, 1981

[30] Foreign Application Priority Data

May 2, 1980 [DE] Fed. Rep. of Germany ..... 3016932

[51] Int. Cl.[3] ..... B25B 15/02

[52] U.S. Cl. ..... 81/438; 81/439; 81/177 G; 145/61 L; 279/79; 279/102

[58] Field of Search ..... 81/439, 461, 177 G, 81/436, 438; 279/102, 1 Q, 79, 96; 29/80; 145/61 L

[56] References Cited

U.S. PATENT DOCUMENTS

| | | | |
|---|---|---|---|
| 1,475,136 | 11/1923 | Olson | 279/102 |
| 1,888,222 | 11/1932 | Curtis et al. | 279/102 |
| 1,961,246 | 6/1934 | Powers | 81/439 |
| 2,089,121 | 8/1937 | Hartung | 279/102 |
| 2,596,594 | 5/1952 | Petre | 81/439 |
| 2,833,548 | 5/1958 | Clark | 81/438 |
| 3,375,860 | 4/1968 | Vosbikian et al. | 279/102 |
| 4,096,896 | 6/1978 | Engel . | |

FOREIGN PATENT DOCUMENTS 881205 1/1943 France .

*Primary Examiner*—Roscoe V. Parker
*Attorney, Agent, or Firm*—Martin A. Farber

[57] ABSTRACT

A screwdriver with replaceable blade is inserted in the longitudinal direction of the handle from one end in non-rotatable complementary manner into an opening having a non-round cross section with which there is associated a spring for holding the blade by friction. The opening is formed from a socket which is of polygonal shape on an inside and an outside thereof and a part (x) of the length thereof is held in non-rotatable complementary manner within the handle while the remaining length (y) thereof projects beyond an end surface of the handle said socket being formed on an inner wall thereof with an annular groove, and a spring of ring shape is disposed partly in the groove.

13 Claims, 4 Drawing Figures

SCREWDRIVER WITH REPLACEABLE BLADE

The present invention relates to a screwdriver having a replaceable blade which can be inserted in the longitudinal direction of the handle from one end in non-rotatable complementary manner into an opening having a non-round cross section with which there is associated a spring for holding the blade by friction.

In one development which is available on the market, two spring half-shells extend from the insertion-side end of the handle and surround the opening. The spring half-shells are connected in non-rotatable complementary manner over a part of their length with diametrically opposite projecting fins on the replaceable blade, while the remaining length of the spring half-shells produces the frictional lock. High torques cannot be transmitted by a screwdriver developed in this manner since this would cause the spring half-shells to break. The transmission of force is also dependent on the size of the diametrically opposite fins on the blade shank of circular cross section.

The object of the present invention is to produce by a simple manner of manufacture, a screwdriver of the above-mentioned type which is more advantageous in use, in that high forces can be transmitted without damage in contradistinction to screwdrivers of the same size.

This object is aided in its solution by the opening being formed from a socket (2) which is of polygonal shape on an inside and an outside thereof and a part (x) of the length thereof is held in non-rotatable complementary manner within the handle (1), while the remaining length (y) thereof projects beyond an end surface (3) of the handle, said socket being formed on an inner wall thereof with an annular groove (8), a spring (9) of ring shape being disposed partly in the groove.

As a result of this development, a screwdriver of the above type which is of increased value in use is produced. The polygonal socket fulfills a multiple function: On the one hand the polygonal shape leads to a firm connection between the handle and the socket. On the other hand, as the blade is inserted, it is guided well as a result of the remaining continuous length of the interior of the socket. In addition, the socket also serves to receive the O-shaped spring which is held in axially non-displaceable manner by the annual groove in the socket. If higher forces are to be transmitted to the blade, the remaining length of the socket which protrudes beyond the handle serves as point of engagement for a driving tool which can be attached in non-rotatable complementary manner. The torque is then transmitted directly from the socket to the blade so that the handle is protected against greater forces. Another advantage is that the spring which lies in the annular groove can be dimensioned in such a manner as to assure a soft, friction-held insertion and removal of the blade. The cost of manufacture can be kept low despite the sturdy construction of the screwdriver.

An advantageous further development resides in formation of the spring as an O ring made of rubber. The latter can be inserted in simple manner and leads to a favorable frictional engagement as a result of which the blade is held fast in dependable manner.

It has furthermore been found advantageous for the polygonal shape on the inside of the socket to extend only over a length which corresponds approximately to the distance by which the socket protrudes beyond the end surface of the handle and for the remaining length, in a region of which the annular groove is located, to be developed as a cylindrical bore of larger cross section than the inner polygon. Upon the insertion of the blade therefore the non-rotatable complementary engagement is first of all produced. Only thereafter does the shank of the blade come into frictional engagement with the O ring.

Finally it is also advantageous for the polygon to be developed as a hexagon. This polygon shape is suitable particularly with the use of tools as power transmission means. For the hexagonal shape of the socket and shank of the blade commercially customary bar material can be used, which also contributes to the reduction in cost of manufacture.

One illustrative preferred embodiment of the invention will be described below with reference to FIGS. 1 to 4, in which.

The screwdriver has a handle 1. The latter is made preferably of a suitable plastic. Into the handle 1 there is inserted in non-rotatable complementary manner a part x of the length of a socket 2 of hexagonal cross section. Its remaining length y projects beyond the end 3 of the handle 1.

Figure 2:
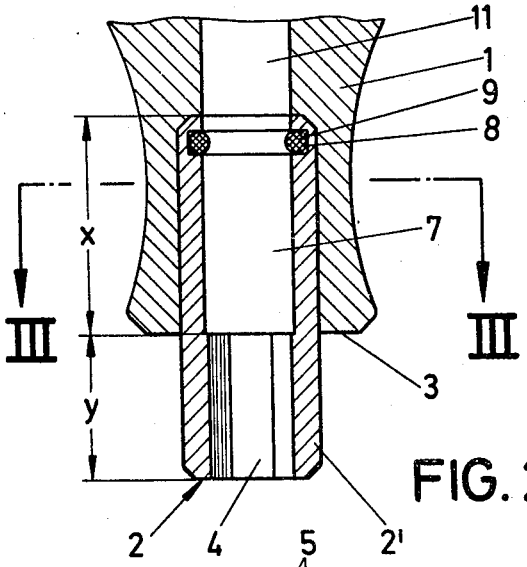
FIG. 2 is a longitudinal central section through the screwdriver in the region of the socket inserted into the handle, but without the blade.
Figure 3:
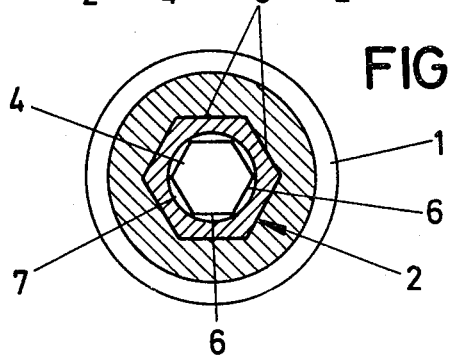
FIG. 3 is a cross section along the line III—III of FIG. 2.
Figure 4:
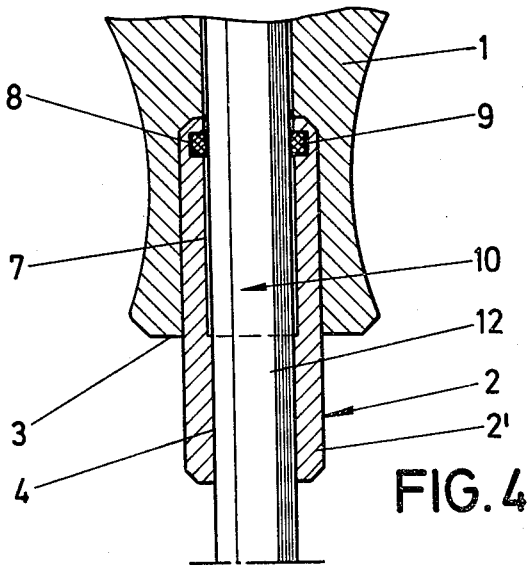
FIG. 4 is a showing similar to FIG. 2 but with the blade inserted.

The socket 2 has a bore 4 of hexagonal cross section aligned in such a manner that the outer hexagon surfaces 5 of the socket 2 lie parallel to the inner hexagon surfaces 6 of the bore 4; seen in particular in FIG. 3. From FIG. 2 it can be noted that the polygonal shape of the socket 2 on its inside extends only over a partial length y corresponding approximately to the distance by which the socket 2 projects beyond the end 3 of the handle 1. The remaining length of the bore 4 corresponds to the length x and is formed as a cylindrical bore 7 of larger cross section than the inner polygon 4. Close to the inner end of the socket 2 an annular groove 8 extends from the bore 7 and is adapted to receive an O-ring 9 of rubber which forms the spring. As shown in FIG. 2, the O-ring 9 lies within the annular groove 8 only in part and its remaining part extends into the path of displacement of the blade 10 which is to be introduced. A blind hole 11 forms an extension of the bore 7 within the handle 1 for the blade.

Figure 1:
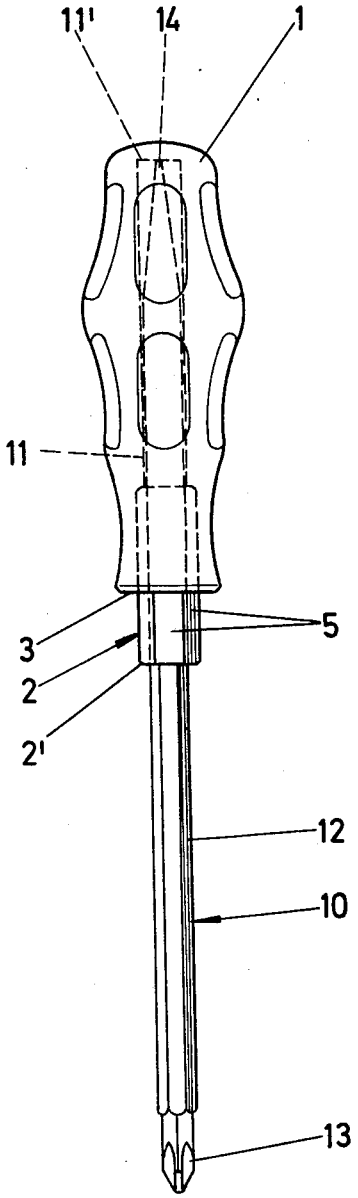
FIG. 1 is a view of the screwdriver with the blade inserted.

The blade 10 comprises a blade shank 12 of hexagonal cross section which is adapted or complementary to the cross section of the hexagonal opening 4. In the embodiment shown by way of example, the blade shank 12 terminates at one end in a Philip's blade 13 and at its other end in an ordinary screwdriver blade 14. In FIG. 1 the Philip's screw blade 13 is in position ready for use while the ordinary screwdriver blade 14 lies within the bore 11 and has its end resting against the bottom 11' of the blind hole 11. The inserted blade 10 is here held in frictional engagement by the O ring 9.

In order to be able to use the ordinary screwdriver blade 14, the blade 10 is pulled completely out of the handle 1 and socket 2. The O ring can then expand into the position shown in FIG. 2. After the blade has been turned around it is introduced with the Philip's screw blade 13 forward into the socket 2. In this case the non-rotatable complementary engagement between the socket 2 and the blade 10 is first produced. Only after a certain length of insertion does the O ring come into frictional engagement with the blade shank 12.

If greater torques are to be transmitted to the blade 10, this can be done with the aid of a suitable pair of pliers or a wrench which engages and projecting acts on the portion 2' of the socket 2. In this case only slight forces are exerted on the handle since the force transmission is conducted directly from the socket to the blade shank 12.

I claim:

1. In a screwdriver with a replaceable polygonal blade and a handle, the blade being insertable in non-rotatable complementary manner from a front end of the handle into a cross-sectionally non-round opening of a socket, the socket with an interior portion of its length being seated non-rotatably in the handle, the opening defined by an inside wall of the socket being cylindrical at a portion thereof and the socket over the remainder of the length inside on the inside wall and outside is polygonal defining corners, the socket with said polygonal remainder of its length projecting beyond the front surface of the handle, and a spring element frictionally locking the blade being coordinated to the socket, the improvement wherein said socket is polygonal on said outside along its entire length, said cylindrical portion of the opening on the inside wall of the socket is formed so as to include an annular groove formed therein and spaced substantially apart from a transition of said opening defined by said inside wall from cylindrical to polygonal, the spring element is formed as a closed annular ring and is partially encased in said annular groove on the inside wall of the cylindrical portion, extends radially inwardly beyond the radius of said cylindrical portion into said opening before said blade is inserted into said opening and forms an integral unit with said socket insertable into the handle, and the cylindrical diameter of said cylindrical portion of the inside wall approximately equals the width across two opposite of said corners of the opening on the inside wall of said polygonal remainder of the length of said socket, said width across said two opposite corners of said inside wall at said polygonal remainder of the length of said socket is defined by said two corners which are 180° opposite each other.

2. The screwdriver according to claim 1, wherein said annular groove is located near an end of said socket in said interior portion which is seated in said handle.

3. The screwdriver according to claim 1, wherein an end of said socket in said interior portion which is seated in said handle is beveled at the outside of said socket.

4. The screwdriver according to claim 3, wherein said annular groove is located near said end of said socket in said interior portion which is seated in said handle.

5. The screwdriver according to claim 1, wherein said annular groove is a cylindrical annular groove defined by a cylindrical peripheral wall and upper and lower surfaces parallel to each other and perpendicularly to said cylindrical peripheral wall.

6. The screwdriver according to claim 1, wherein said closed ring has a circular axial cross section.

7. The screwdriver according to claim 1, wherein said ring is an O-ring.

8. The screwdriver according to claim 1, wherein the polygonal shape of the socket on said inside thereof extends only over approximately said remaining length of said socket corresponding approximately to the distance by which said socket projects beyond said end surface of the handle, said part of the length of said socket is formed with a cylindrical bore of larger cross section than said polygon shape on said inside of said socket, said annular groove is formed within said cylindrical bore.

9. The screwdriver according to claim 8, wherein said cylindrical bore and said polygonal shape on said inside of said socket extend into each other coaxially and form said opening.

10. The screwdriver according to claim 1, wherein said polygon is a hexagon.

11. The screwdriver according to claim 1, wherein said handle is formed with a blind hole having a polygonal shape corresponding to that of said outside of said socket and said blade is formed with a polygonal shape corresponding to that of said inside of said socket.

12. The screwdriver according to claim 11, wherein the blind hole in said handle is a stepped opening in which said interior portion of the length of said socket is mounted, said blind hole includes a cylindrical innermost portion of said stepped opening constituting a continuation of said opening in said socket and defining a bottom wall, an end of said blade abuts against said bottom wall in an inserted position of said blade into the socket and said handle.

13. The screwdriver according to claim 1, wherein said ring is made of rubber.

* * * * *